US007264541B1

(12) United States Patent
Ray et al.

(10) Patent No.: US 7,264,541 B1
(45) Date of Patent: Sep. 4, 2007

(54) DRYWALL CORNER SANDER

(75) Inventors: Jay L. Ray, Clive, IA (US); Jayson L. Ray, Clive, IA (US); Josh R. Ray, Waukee, IA (US)

(73) Assignee: Drywall Ideas, LLC, Clive, IA (US)

( * ) Notice: Subject to any disclaimer, the term of this patent is extended or adjusted under 35 U.S.C. 154(b) by 0 days.

(21) Appl. No.: 11/551,547

(22) Filed: Oct. 20, 2006

(51) Int. Cl.
*B24B 23/00* (2006.01)

(52) U.S. Cl. ..... 451/344; 451/354; 451/524

(58) Field of Classification Search ..... 451/354, 451/344, 523, 524, 525
See application file for complete search history.

(56) References Cited

U.S. PATENT DOCUMENTS

| | | | | |
|---|---|---|---|---|
| 2,711,059 | A | 6/1955 | Ames | |
| 2,817,931 | A * | 12/1957 | Houser | 451/522 |
| 3,279,130 | A * | 10/1966 | Nelson | 451/522 |
| 3,713,744 | A * | 1/1973 | Sims | 401/9 |
| 3,842,549 | A | 10/1974 | Johnston | |
| 4,525,959 | A | 7/1985 | Ziebarth | |
| 4,774,789 | A | 10/1988 | Amalfi | |
| 4,825,597 | A * | 5/1989 | Matechuk | 451/524 |
| 4,887,396 | A | 12/1989 | Lukianoff | |
| 5,337,523 | A * | 8/1994 | Walsh | 451/502 |
| 5,345,724 | A | 9/1994 | Ng, Jr. | |
| D373,715 | S * | 9/1996 | Fink | D8/90 |
| 5,605,500 | A * | 2/1997 | Matechuk | 451/456 |
| 5,718,622 | A | 2/1998 | Jones | |
| 5,895,316 | A | 4/1999 | Williams | |
| 5,954,571 | A * | 9/1999 | Case | 451/354 |
| 6,325,708 | B1 * | 12/2001 | Miles | 451/354 |
| D497,092 | S | 10/2004 | McCarthy | |
| 7,011,570 | B1 * | 3/2006 | Mac Leod | 451/356 |
| 7,011,573 | B2 * | 3/2006 | McArthur et al. | 451/523 |
| 2001/0000503 | A1 * | 4/2001 | Beaudry et al. | 451/523 |
| 2004/0043715 | A1 * | 3/2004 | Miles | 451/526 |
| 2006/0063479 | A1 * | 3/2006 | Annis et al. | 451/557 |

* cited by examiner

*Primary Examiner*—Eileen P. Morgan
(74) *Attorney, Agent, or Firm*—McKee, Voorhees & Sease, P.L.C.

(57) ABSTRACT

An improved drywall corner sander is provided with an elongated body having opposite sides, and a pair of spaced apart braces extending between the sides. An axle is pivotally mounted between the braces so as to define a first longitudinal pivot axis. A tab on the axle defines a second, perpendicular pivot axis. A handle is connected to the tab of the axle so as to be pivotal about the first and second axes for easy operation of the sander without forming grooves in the side wall adjacent the outer edges of the sander. The pivot axes both reside within the cavity defined by the side walls of the sander.

21 Claims, 4 Drawing Sheets

DRYWALL CORNER SANDER

FIELD OF THE INVENTION

The present invention is directed towards a dry wall sander for sanding the inside corners of converging walls and more particularly, to a corner sander having a universally pivotal handle.

BACKGROUND OF THE INVENTION

Sanders for drywall or sheet rock are well known. Generally, prior art sanders come in two forms, a flat sander for the primary, flat wall surfaces, and an angle or corner sander for sanding the inside corner of converging walls. Universally pivotal handles are known for both flat and corner sanders. For example, U.S. Pat. No. 2,711,059 discloses a flat sander with a universal handle which is pivotal about two perpendicular axes. U.S. Pat. No. 6,325,708 discloses a corner sander having a handle pivotal about two axes. However, the axes for such universal pivoting handles are located above or outside the body of the sander, thus adding to the bulk of the sander and increasing the storage space required for the sander. Also, the location of the pivot axes above or outside the outer edges of the base or body tend to transmit excessive sanding forces to the outer edges of the attached sanding pad, which may produce undesirable grooves in the drywall along the outer edges of the corner sander.

Therefore, a primary objective of the present invention is the provision of an improved drywall corner sander.

Another objective of the present invention is the provision of an improved corner sander having a universally pivotal handle.

A further objective of the present invention is the provision of a drywall corner sander having a pivotal handle which minimizes sanding forces which may produce grooves in the drywall.

Yet another objective of the present invention is the provision of an improved corner sander having a handle with pivot axes residing within the cavity of the sander.

Another objective of the present invention is the provision of an improved drywall corner sander which is economical to manufacture, and simple and efficient to use.

These and other objectives will become apparent from the following description of the invention.

BRIEF SUMMARY OF THE INVENTION

The improved drywall corner sander of the present invention includes an elongated body having opposite left and right sides interconnected to form a juncture and a cavity between the sides. A pair of spaced apart braces extend between the sides, substantially perpendicular to the longitudinal axis of the body. A first axle extends between the braces adjacent the inside corner of the body so as to define a longitudinal pivot axis. A tab on the axle extends outwardly from the juncture of the sides and includes a second pivot axis perpendicular to the longitudinal axis. A handle is attached to the tab so as to be universally pivotal about the first and second axes. Both axes reside within the cavity of the corner sander, so as to minimize sanding forces along the outside edges of the side walls.

DETAILED DESCRIPTION OF THE PREFERRED EMBODIMENT

Figure 1:
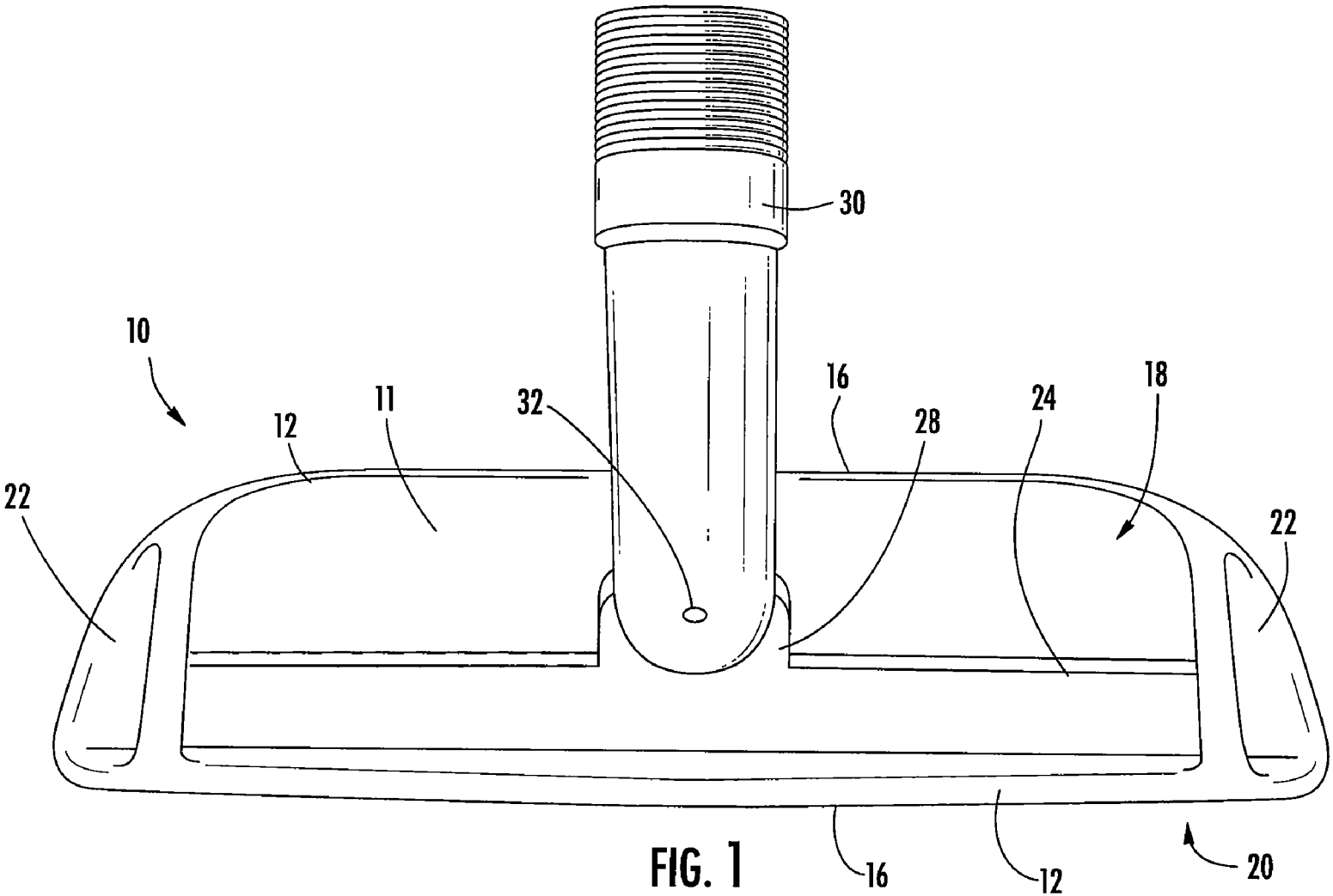
FIG. 1 is an elevation view of the corner sander of the present invention with the base of a handle attached thereto.
Figure 2:
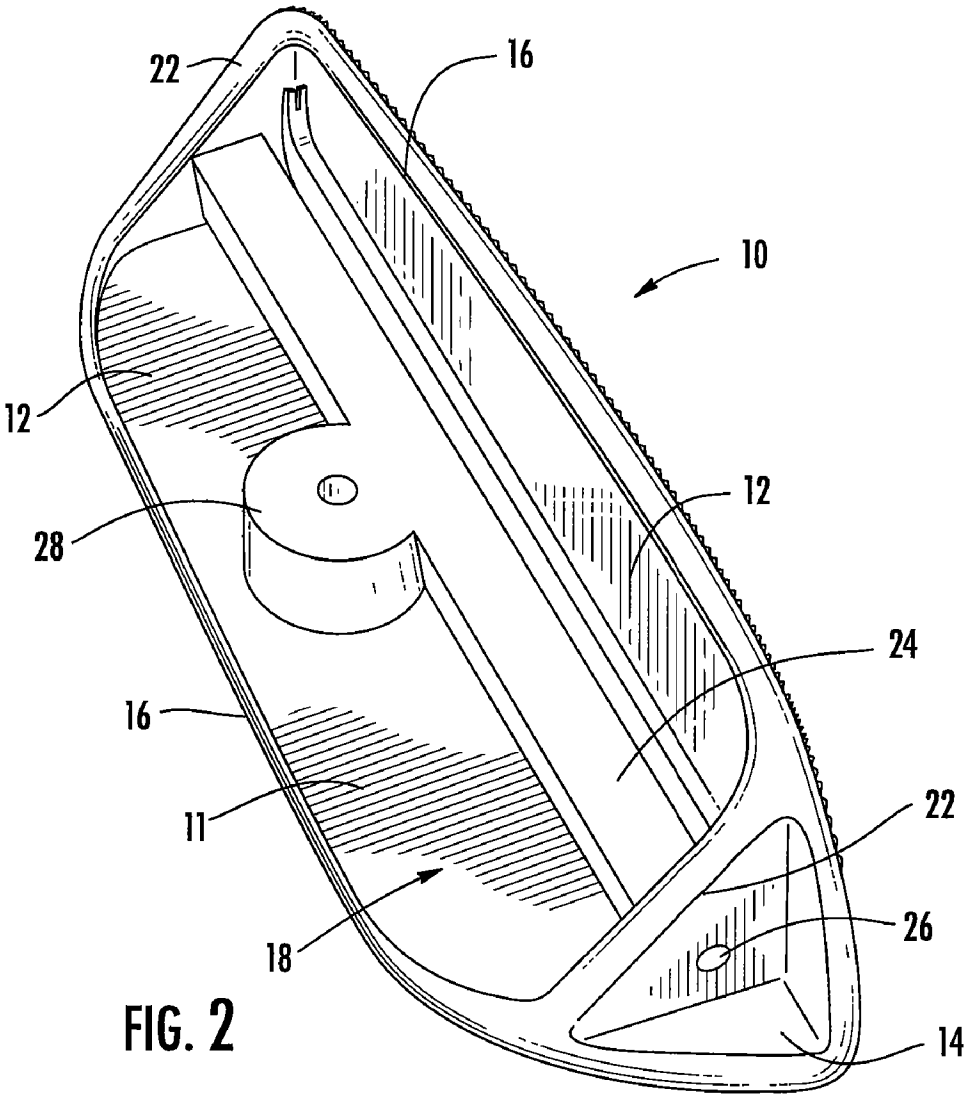
FIG. 2 is a perspective view of the corner sander, with the handle removed.
Figure 3:
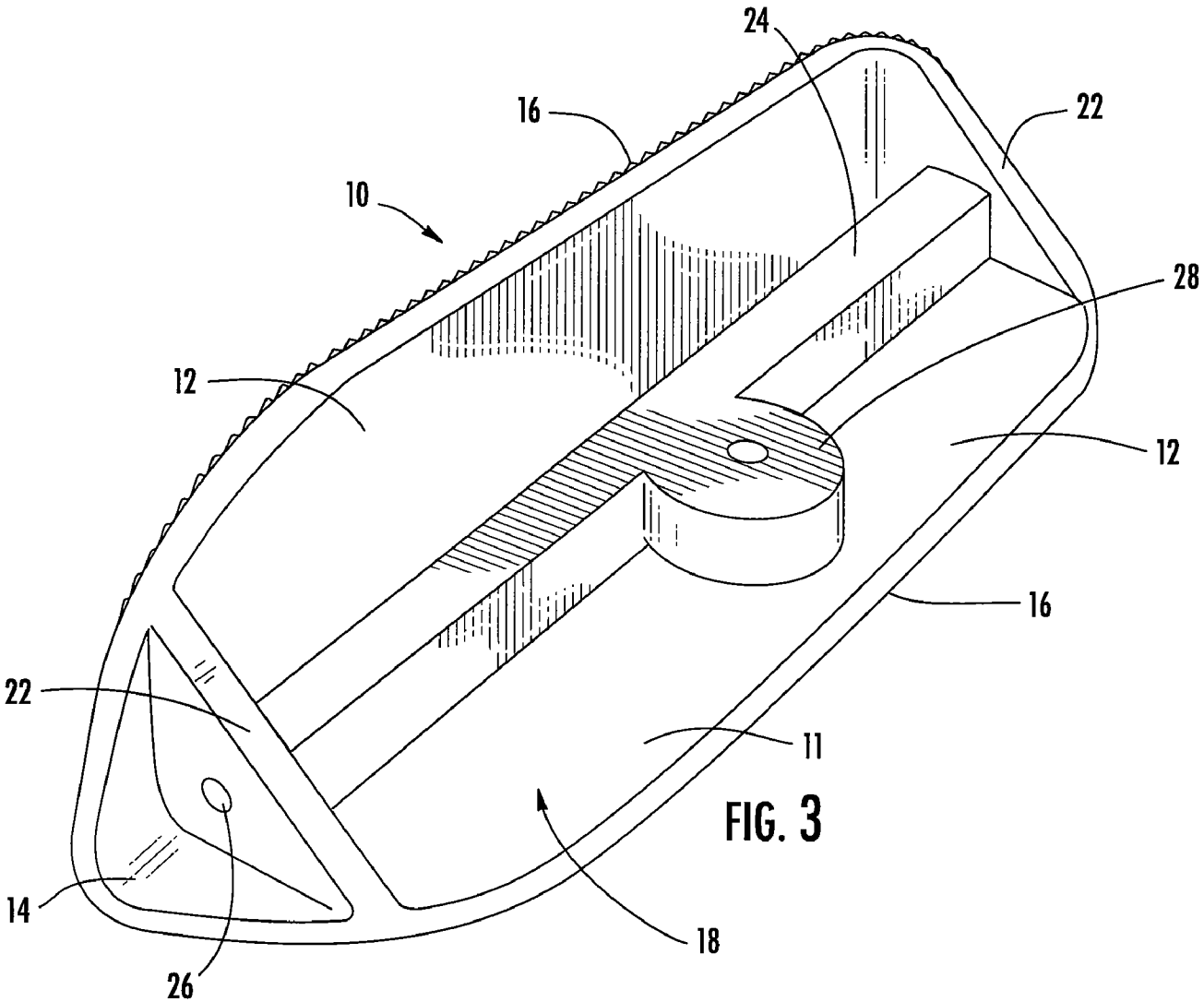
FIG. 3 is another perspective view of the corner sander, without a handle.
Figure 4:
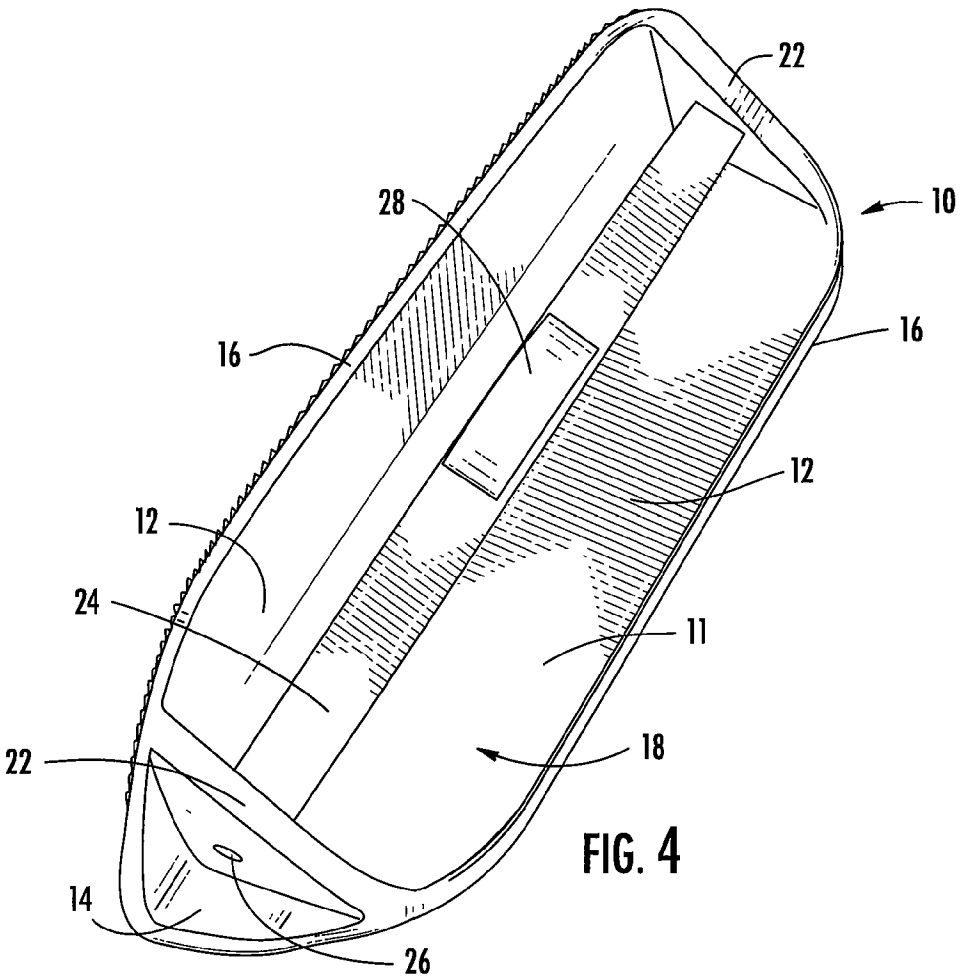
FIG. 4 is another perspective view of the corner sander, without a handle.

The improved drywall corner sander of the present invention is generally designated by the reference numeral 10 in the drawings. The sander includes an elongated body 11 having opposite side walls 12. The side walls interconnect at an angle of 90°, or slightly less, so as to define a juncture or inside corner 14. The side walls 12 each have an outer edge 16, so as to define a cavity 18 between the side walls 12. The outer faces of the side walls 12 are adapted to receive a sanding pad (not shown). The sanding pad may be connected to the outer faces 20 of the side walls 12 in any convenient manner, such as by adhesive or loop and hook fastener material. Preferably, the sanding pad has a beveled edge, as described in Applicant's co-pending application, U.S. Ser. No. 11/190,586 filed on Jul. 27, 2005 and entitled ANGLE SANDER.

A pair of spaced apart braces 22 extend between the side walls 12 and the cavity 18 of the sander 10. An axle 24 extends between the braces 22 so as to define a first longitudinal pivot axis parallel to the longitudinal axis of the body 11. The ends of the axle 24 may be connected to the braces 22 in any convenient manner, such as pins 26, which thus define the longitudinal pivot axis.

The axle 24 includes a tab or ear 28 extending inwardly or outwardly away from the inside corner 14. The tab is adapted to receive the end of a handle 30, which is connected to the tab by a pin 32 defining a second pivot axis perpendicular to the longitudinal pivot axis. Thus, the handle 30 is adapted to pivot upwardly and downwardly about the pivot pin 32 and pivot left and right about the pins 26. Thus, the cylinder 10 can be easily moved upwardly and downwardly along a drywall corner, with the operator standing adjacent either of the two walls or anywhere between the two walls. Both pivot axes reside within the cavity 18 defined by the side walls 12, such that the pressure on the sander 10 applied by the operator via the handle 30 is concentrated at the juncture of the side walls 12, and is minimized at the outer edges 16 of the body 11. Accordingly, this construction of the sander 10 minimizes the forces which otherwise tend to form grooves in the side wall, as in prior art corner sanders.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved drywall corner sander comprising:

an elongated body having opposite left and right sides interconnected to form a juncture and having opposite ends so as to define a longitudinal axis;

a pair of spaced apart braces extending between the sides and perpendicular to the longitudinal axis;

an axle extending between the braces so as to be parallel to the longitudinal axis and defining a longitudinal first pivot axis;

a tab on the axle extending outwardly from the juncture of the sides; and a second pivot axis extending through the tab perpendicular to the longitudinal axis.

2. The corner sander of claim 1 wherein the first and second pivot axes reside within the sides of the body.

3. The corner sander of claim 1 wherein the first and second pivot axes do not intersect.

4. The corner sander of claim 1 wherein the first and second pivot axes are in different elevational planes.

5. The corner sander of claim 1 further comprising a handle connected to the tab so as to pivot about the first and second pivot axes.

6. The corner sander of claim 5 wherein the handle includes a pair of spaced apart ears extending on opposite sides of the tab, and a pin extending through the tab to define the second pivot axis.

7. The corner sander of claim 1 wherein the braces are integrally formed with the sides.

8. A corner sander, comprising:

first and second side walls disposed at right angles and joined to define inside and outside corners and a longitudinal axis;

an axle pivotally connected to the side walls and extending longitudinally to define a first pivot axis extending longitudinally adjacent the inside corner;

a second pivot axis formed on the axle and extending transversely to the first pivot axis;

the first and second axes being at different elevations; and a handle connected for pivotal movement about the first and second axes.

9. The corner sander of claim 8 further comprising a pair of longitudinally spaced apart braces extending between the side walls, and the axle having opposite ends pivotally mounted to the braces.

10. The corner sander of claim 9 wherein the braces are integrally formed with the side walls.

11. The corner sander of claim 8 further comprising a tab on the axle extending away from the inside corner, and through which the second pivot axis extends.

12. The corner sander of claim 11 wherein the handle is connected to the tab.

13. The corner sander of claim 8 wherein the side walls have opposite outer edges and the first and second axes are both located inside the outer edges.

14. A corner sander, comprising:

first and second side walls disposed at right angles and joined to define a longitudinal axis and inside and outside corners;

an axle mounted to the side walls adjacent and parallel to the inside corner and defining a first pivot axis;

a second pivot axis on the axle extending transversely to the first pivot axis; and the side walls having opposite outer edges defining a cavity between the side walls and the axle residing within the cavity.

15. The sander of claim 14 further comprising a handle attached to the axle for pivotal movement about the first and second axes.

16. The corner sander of claim 14 wherein the first and second axes do not intersect.

17. The corner sander of claim 14 further comprising first and second spaced apart braces extending between the side walls, and the axle having opposite ends pivotally mounted to the braces to define the first pivot axis.

18. The corner sander of claim 17 further comprising a tab on the axle extending away from the inside corner, and through which the second pivot axis extends.

19. The corner sander of claim 18 wherein the handle is connected to the tab.

20. The corner sander of claim 17 wherein the side walls and braces are formed as a single piece.

21. The corner sander of claim 17 wherein each brace is triangular with adjacent edges connected to the first and second side walls.

* * * * *